US005355601A

United States Patent [19]

Paulsen

[11] Patent Number: 5,355,601

[45] Date of Patent: Oct. 18, 1994

[54] PORTABLE PUBLIC DISPLAY APPARATUS FOR ILLUMINATING A DRIVEN TRANSPARENT MATERIAL

[76] Inventor: Darryl L. Paulsen, 506 Follow Thru, Yakima, Wash. 98901

[21] Appl. No.: 929,882

[22] Filed: Aug. 11, 1992

[51] Int. Cl.[5] ..... G09F 11/18

[52] U.S. Cl. ..... 40/471; 40/518

[58] Field of Search ..... 40/471, 472, 743, 470, 40/438, 518, 483, 524, 526, 529, 530, 533

[56] References Cited

U.S. PATENT DOCUMENTS

| | | | |
|---|---|---|---|
| 2,585,687 | 2/1952 | Sanderson | 40/472 |
| 2,867,050 | 1/1959 | Westfall | 40/472 |
| 3,600,834 | 7/1971 | Stamer | 40/472 |
| 3,703,778 | 11/1972 | Pfleger | 40/472 |
| 3,729,731 | 4/1973 | Konnerth et al. | 40/472 |
| 3,754,342 | 7/1993 | Santacroce et al. | 40/472 |
| 4,201,002 | 5/1980 | Barton | 40/472 |
| 5,072,533 | 12/1991 | Doepgen | 40/472 |

*Primary Examiner*—Clifford D. Crowder
*Assistant Examiner*—Larry D. Worrell, Jr.
*Attorney, Agent, or Firm*—Stratton Ballew Richardson

[57] ABSTRACT

A public display apparatus that provides a relatively large, high-quality visual image by using a sheet of flexible transparent material with high-quality images on it suspended between a driven roller and a tension roller inside a container body. The rollers are parallel with a distance between them creating a display area. A driving source is connected to the driven roller to rotate the driven roller and move a sheet with the images either forward or backward. A tension source is connected to a tension roller to maintain the tautness of the sheet with high-quality images and the visual images distortion free.

1 Claim, 3 Drawing Sheets

PORTABLE PUBLIC DISPLAY APPARATUS FOR ILLUMINATING A DRIVEN TRANSPARENT MATERIAL

TECHNICAL FIELD

This invention relates to a public display apparatus. More particularly, the apparatus of this invention relate to the use of photographic images in a scrolling display.

BACKGROUND OF THE INVENTION

The use of relatively large visual displays at public events, such as sporting events, trade show and conventions, is well known. Signs that were changed by hand have been replaced by motor driven signs.

Scroll signs are one type of motor driven sign that has been use in applications, such as numbers for scoreboards. Existing scroll signs use a strip of web or film which is wrapped around two parallel rollers which can be oriented either vertically or horizontally. The display area is the area between the two rollers. As the rollers are rotated, the display is changed. Existing scroll signs have proven unsuitable for larger visual displays. Existing scroll signs have proven unable to maintain an undistorted visual image when the web or film containing the image has a larger size.

More recently, electronic signs have been used for visual displays at public events. The electronic signs have some advantages. They are typically computer contolled and can offer a sometimes dazzling variety of displays. Also, electronic signs have fewer moving mechanical parts, they may be less maintenance intensive than motor driven signs.

At the same time, there are several disadvantage with electronic signs. First, the visual quality of electronic signs is not particularly high. With electronic signs that use light bulbs for the visual display, the visual quality is crude. Even with the use of more advanced display elements such as LED's or large television-like displays, the quality of the image is not particularly high. Also, while electronic signs may have fewer mechanical parts, they frequently have a complex array of components, including computer controllers and software. Failure of a component can lead to the complete shut down of the display.

Another disadvantage of electronic signs, especially the larger types used at public events is that their complexity makes them extremely expensive to manufacture and purchase. Typically, they are installed only as permanent displays in large arenas, such as sports arenas or convention halls.

As illustrated by the above discussion there are a number of desirable features for a public display apparatus. It would be desirable for a public display apparatus to have a high quality visual image. It also would be desirable for a display apparatus to be reliable. In addition, it would be desirable for a public display apparatus to be economical to produce. Futher, it would desirable for a public display to be portable.

While the discussion herein relates to public display apparatuses and methods, it is not intended that the invention be limited to this situation. It will be obvious from the description that follows that the present invention will be useful in other applications with problems common to those described here.

DISCLOSURE OF THE INVENTION

It is an object of the present invention to provide a public display apparatus that has a high quality visual image.

It also is an object of the present invention to provide a public display apparatus that is reliable.

It is a further object of the the present invention to provide a public display apparatus that is economical to produce.

It is an additional object of the present invention to provide a public display apparatus that is portable.

It is yet another object of the present invention to provide a public display apparatus that is part of another structure.

The present invention achieves these and other objectives which will become apparent from the description that follows, by providing a public display apparatus that provides a relatively large high quality visual image.

In a preferred embodiment of the present invention, a sheet of flexible, transparent material with high quality images on it is suspended between a driven roller and a tension roller inside a container body. The rollers are parallel with a distant between them that creates a display area. Both the driven roller and the tension roller are relatively long and are long enough to allow photographic images to be large enough for visual displays at public gatherings, such as sporting events, conventions, fairs, etc., to be used. A driving source is connected to the driven roller to rotate the driven roller and move the sheet. A tension source is connected to the tension roller to maintain tension on the tension roller which keeps the sheet taut and the visual images distortion free.

In an alternative preferred embodiment of the present invention, the display apparatus is virtually identical to the above preferred embodiment. In this preferred embodiment, the display apparatus also has a secondary rollers for the driven roller and a secondary roller for the tension roller. These secondary rollers are parallel to and substantially the same length as the driven and tension rollers respectively. Each of the secondary rollers are positioned a relatively short distance from the corresponding driven or tension roller and the flexible material passes from the driven roller to and over the corresponding secondary roller, across an open area between the secondary rollers, over the other secondary roller, and around the tension roller. In this embodiment, the display area is the area between the secondary rollers.

In another alternative preferred embodiment of the present invention, the display apparatus also uses secondary rollers. In this preferred embodiment, however, there are support arms which extend from a frame to provide additional structural support and strength to the secondary rollers. Each support arm curves outward from the frame and has support wheels which contact the corresponding secondary roller and against which the secondary rollers rest. The support arms allow maximum londitudinal rigidity in the secondary rollers, which is essential for a distortion free visual image on larger displays, while allowing the secondary rollers to rotate freely during the operation of the display apparatus to change images.

A further alternative preferred embodiment of the present invention incorporates the display apparatus of the above alternative preferred embodiment into a table for use at public events. This embodiment provides a table which may be used for judges of a public event, as a press table, or as a scorers table for a sporting event. This embodiment provides the necessary features for those functions together with the public display apparatus for visual displays at the public events. The entire apparatus can be transportable so it can be used for different events at diverse locations.

DETAILED DESCRIPTION OF PREFERRED EMBODIMENTS

Figure 1:
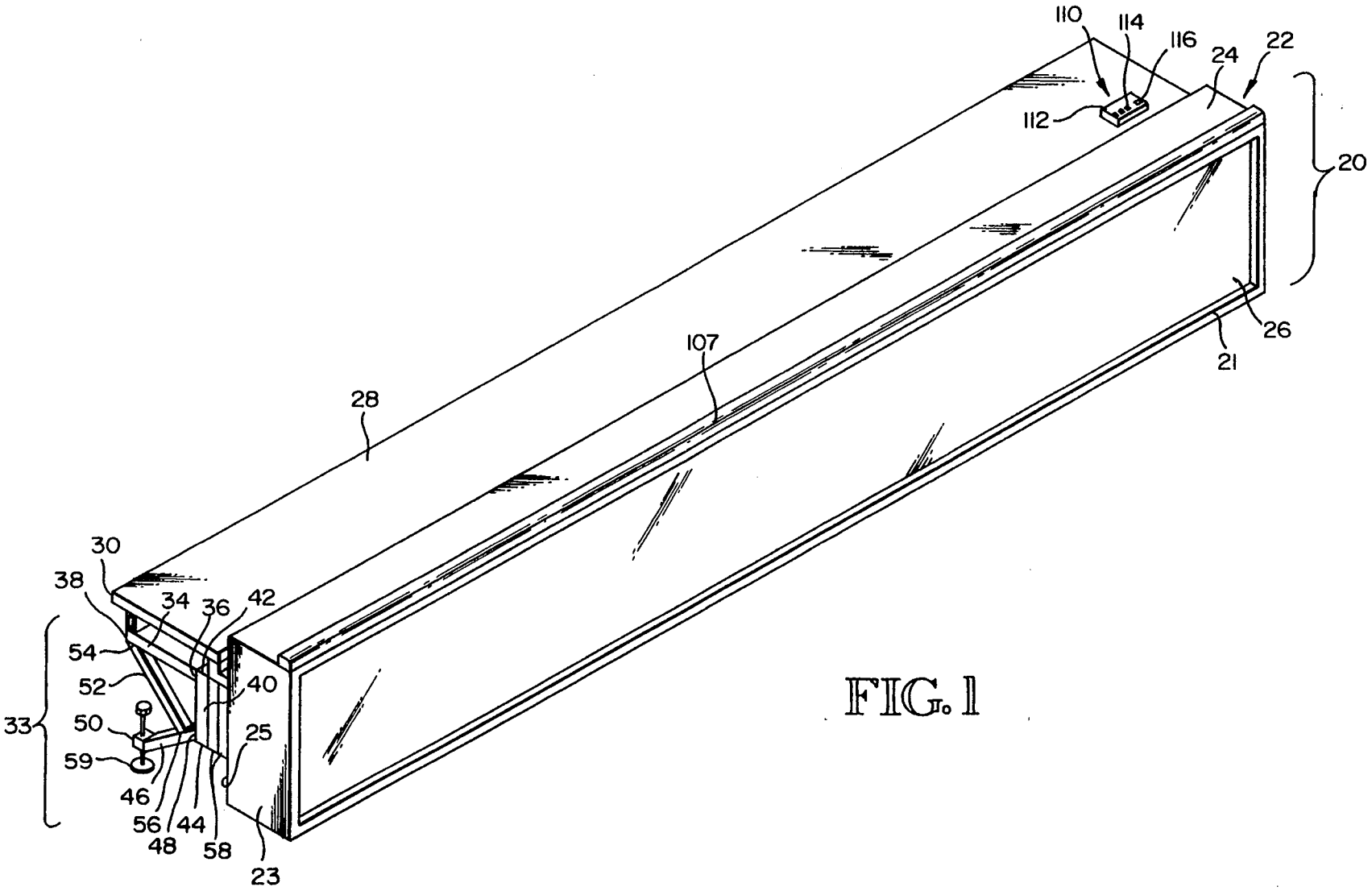
FIG. 1 is perspective view of a preferred embodiment constructed in accordance with the present invention.

With reference to FIG. 1, a public display apparatus 20 is shown. The public display apparatus is contained primarily in a container body 22 which is substantially enclosed and has sides 23, a top 24, a back 25, and a transparent crash shield 26 forming the front 21 of the container body.

A flat planar shelf 28 with a front edge 29 and a back edge 30 extends backward from the container body. The shelf is substantially the same length as the container body and is affixed to the back 27 of the container body 22 along its length. In this embodiment, the shelf is affixed to the container body with at least one hinge 31 proximate the shelf front edge. Affixed underneath the shelf proximate its back edge is a support rail 32 which extends substantially the length of the shelf and adds structural strength. In this embodiment, the shelf serves as a table top for use by persons at public events, such as press reporters, judges of contests, or scorers at athletic events. A shelf support assembly 33 is attached to the shelf and the container body. The shelf support assembly has a horizontal member 34 with a first end 36 and a second end 38, a vertical member 40 with a top 42 and a bottom 44, a lower member 46 with a first end 48 and a second end 50, and a connecting member 52 with a first end 54 and a second end 56. Affixed to the back of the container body are attachment plates 58.

The shelf support assembly 33 is constructed with the horizontal first end 36 affixed to the top 42 of the vertical member 40, and extends horizontally from the vertical member beneath the shelf 30. Between the shelf support rail 32 rests on the horizontal member second end. The first end 48 of the lower member is affixed to the bottom 44 of the vertical member, and extends diagonally downward from the vertical member. The connecting member 52 extends diagonally between the horizontal and lower members with its first end 54 affixed to the horizontal member second end and its second end affixed to the lower member between the lower member ends. The shelf support assembly is attached to the attachment plates 58 by hinges 60 which are affixed to the attachment plates and to the vertical member. An adjustable foot 59 is attached to the lower member second end 50 to help stablize and support the container body.

The hinges 60 for the shelf support asssembly 33 allow each of the assemblies to be folded against the container body. The shelf hinge 31 allows the shelf to fold down over the folded shelf support assemblies. This collapsed configuration enhances the transportability of the public display apparatus 20. The number of shelf support assemblies used with a particular container body 22 varies with the length of the container body. Practice has shown that typically shelf support assemblies used every 3 to 5 feet.

Figure 2:
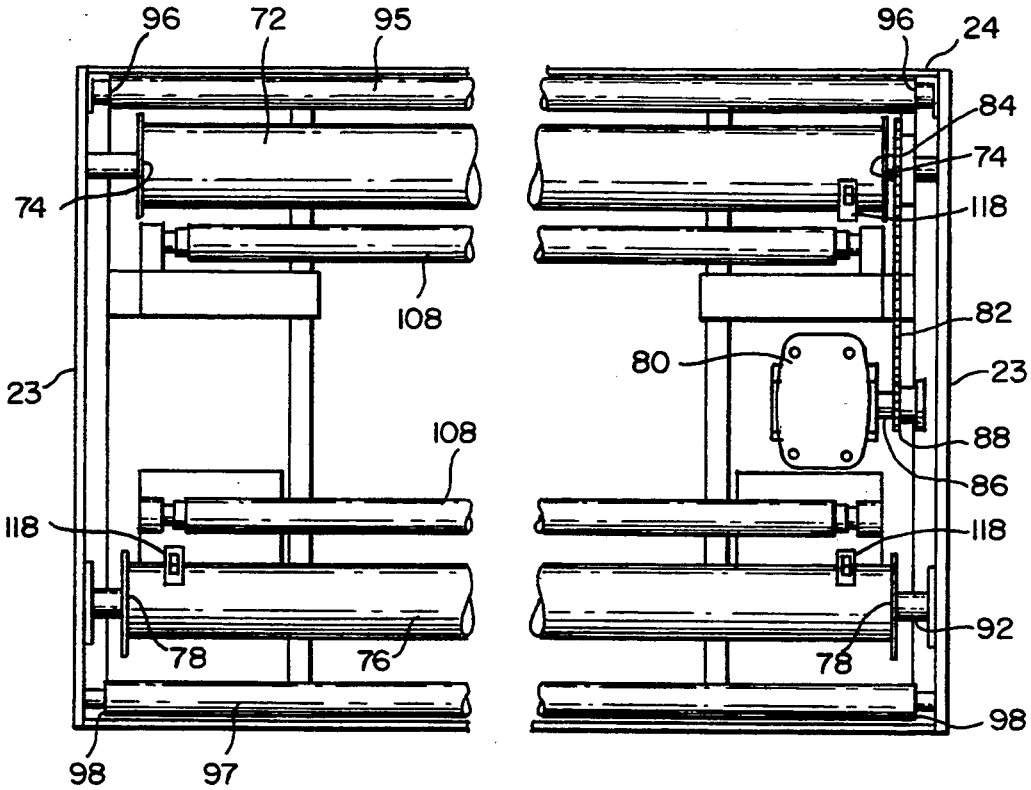
FIG. 2 is a partial front plane view of an alternative preferred embodiment constructed in accordance with the present invention.
Figure 3:
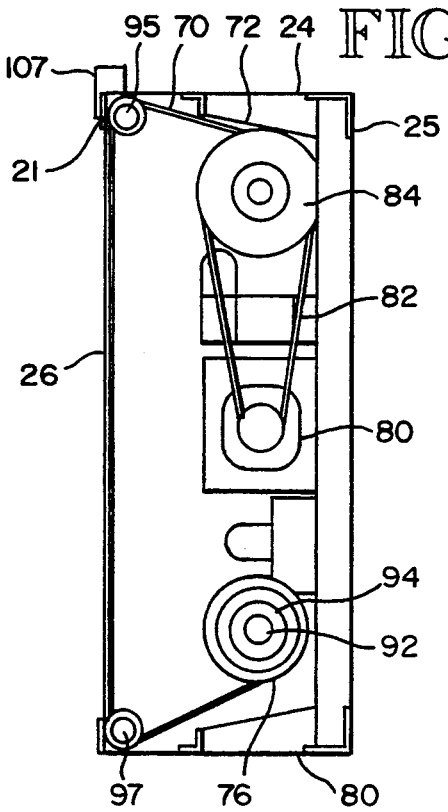
FIG. 3 is a side cross section view of an alternative preferred embodiment constructed in accordance with the present invention.
Figure 4:
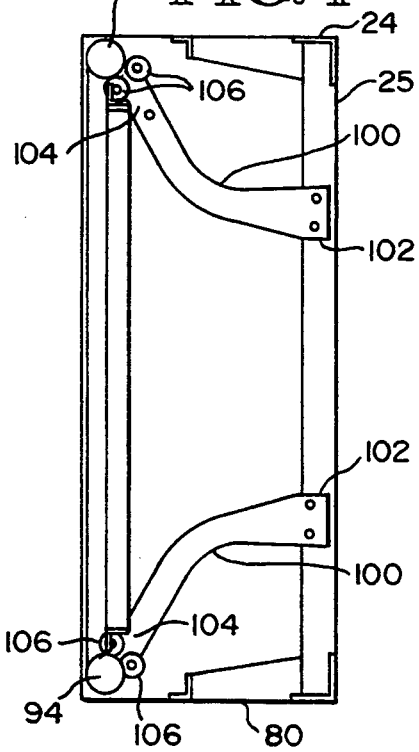
FIG. 4 is a side cross section view of an alternative preferred embodiment constructed in accordance with the present invention.
Figure 5:
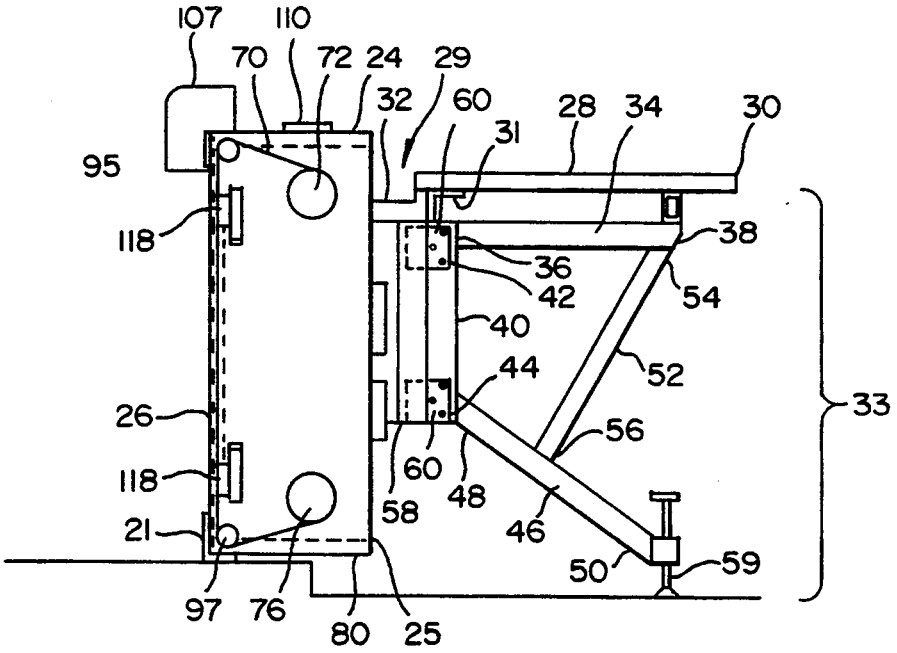
FIG. 5 is a side cross section view of an alternative preferred embodiment constructed in accordance with the present invention.

With reference to FIGS. 2–4, those elements related to the presentation of the visual images are illutrated. Photographic quality images are transferred to a flexible, transparent sheet 70. The sheet most typically has a rectangular shape. The sheet can be made from a number of any number of materials as long as they have the necessary qualities of transparency, flexibility, and sufficient structural strength to resist distortion, tearing or otherwise breaking. Vinyl substrate material has been used successfully. While images on the sheet do not have to be photographic quality, the ability to display such high quality images in a relatively large format is one of the many advantages of the present invention over existing display systems.

Within the container are a driven roller 72 with two ends 74 and a tension roller 76 with two ends. Both the driven and tension rollers are rotatable suspended in and attached to the container body 22. In this embodiment, the driven roller is located proximate the container body top 24 and back 25, while the tension roller is located proximate the container body bottom 80 and back. The position of the driven and tension rollers could interchanged with the tension roller proximate the container body top and the driven roller proximate the container bottom if desired.

The driven roller 72 is connected at one end 74 to transmission 80 by a chain drive 82. At each end of the driven roller is a sprocket 84 around which the chain drive passes. A shaft 86 extends out of the transmission with a sprocket 88 around which the chain drive also passes. The transmission shaft is connected also to motors 90. When the motor is activated, it turns the transmission shaft which, in turn, rotates the driven shaft.

The tension roller 76 has an internal shaft 92 that is fixedly attached to the container body. Attached to the interal shaft is a tension spring 94. The tension spring is wrapped around the internal shaft and attached to the inside of the tension roller. In effect, the tension spring is preloaded by rotating the tension roller so that the tension roller will have a torsional force which enables it to rotate only in one direction without an external force acting on it.

Within the container body also are an upper secondary rollers 95 with two ends 96, and a lower secondary roller 97 with two ends 98. Both secondary rollers are located proximate the container body front 21 with one located proximate the container body top 24 and one proximate the container body bottom 80. The secondary rollers are rotatably attached to the container body at their ends. As with the driven and tension rollers, the secondary rollers, extend substantially the length of the container body and are substantially parallel to each other and the driven and tension rollers.

Also located within the container body 22 is at least one support arm 100. As illustrated in FIG. 4, each support arm has a fixed end 102 and a roller end 104. The fixed end is affixed to the container body proximate the container body back 25. At least two support wheels 106 rotatably attached to the roller end. The support arms are curved along their length so that the support arms curve either upward or downward from the fixed ends. This configuration of the support arms positions the roller ends proximate one of the secondary rollers 95 and 97. At the same time, the curved configuration of the support arms avoids interference with the rotation of the driven roller 72 or the tension roller during their operation. The support wheels are positioned to rotate about axes that are parallel to each other as well as the secondary rollers. The secondary rollers are positioned against and supported by the support wheels which allow the secondary rollers to rotate freely while providing lateral support against sagging.

The container body 22 of the present invention can come in a variety of sizes. Success has been achieved with container bodies having lengths of approximately 16 for events in a sports arena. This length is only indicative of the success in using the present invention to display large high quality images at public events. Experiments indicate that the present invention is equally successful with container bodies having a length of 4 feet up to 20 feet or more. The use of support arms 100 typically are need for container bodies having lengths of more than 4 to 5 feet. By way of example, support arms are placed approximately every 4 feet in 16 feet long container bodies. Similarly, container bodies 22 can vary in height. By way of example, a container body that is 16 feet long has a height of 2.75 feet.

The public display apparatus 20 shown in FIG. 1 is used for events in sporting arenas, as well as other public venues. There is a pad 107 across the container body top 24 proximate the container body front 21 to prevent injury in the event someone were to fall on the container body 22. Also, electrical outlets 109 and radio outlets 111 are provided for use by persons sitting behind the display apparatus. The embodiments of the present invention can be customized as required. Slide out handles 113 can be used to aid the transportation of the public display apparatus 22. Materials for construction of the container body can be any material with sufficient structural strength. Aluminum has been used as a successful compromise of strength and weight. Multiple container bodies can be used to have multiple displays if desired.

The sheet 70 bearing the visual images to be displayed is illuminated from within the container body 22 by at least one light source. In this embodiment, two rows of florescent light tubes 108 are used. The florescent light tubes are located above and proximate the tension roller 76, and below and proximate the driven roller 72. The florescent light tubes are oriented so that they are substantially parallel to the corresponding roller. The florescent light tubes 108 illuminate the sheet 70 from the inside of the container body 22 through the container body front 21 which is substantially open. The curved shape of the support arms allows the secondary rollers to be supported without interfering with lighting and display of the visual images. The crash shield 26 which covers most of the container body front serves two purposes. First, it is made of a transparent material to allow the display of the visual images. The crash shield also acts to protect the sheet from contact and damage. Any mateial having the properties of transparency and sufficient strength to protect the sheet can be used for the crash shield. One material that has been used with success is LEXAN®.

In operation, the sheet 70 is attached to and wrapped around the driven roller 72. The sheet passes over the upper secondary roller 95 proximate the container body top 24. The sheet then passes under and around the lower secondary roller 97 proximate the container body bottom 80. Finally, the sheet wraps around and attaches to the tension roller 76. The sheet and the images contained thereon is held taut, and therefore distortion free, between the secondary rollers by the tension provided from the tension roller 76 and its tension spring 94. This is important since the area between the secondary rollers constitutes the display area where the visual images to be displayed are positioned.

To advance the sheet 70 to a new image, the motor 90 is activated and the driven roller 72 rotates counterclockwise unwrapping some portion of the sheet wrapped around it. The tension roller 76 automatically rotates counterclockwise due to the tension spring 94 as the driven roller rotates releasing the tension on the sheet. The sheet moves down across the front 21 of the container body. The tension roller acts to keep the sheet taut and distortion free by maintain the tension on the sheet as the driven roller rotates.

To return the sheet 70 to a previous image, the motor 90 is activated and the driven roller 72 rotates clockwise rewrapping the sheet around it. In this case, the tension roller 76 also rotates clockwise unwrapping the sheet from it. Here, the sheet moves up across the front 21 of the container body 22. Again, the tension roller keeps the sheet taut and distortion free between the upper and lower secondary rollers 95 and 97. In this case, the tension roller and its tension spring 94 resist the pull exert by the rotation of the driven roller.

Control of image selection is accomplished by a simple controller 110. The controller has a down button 112 to advance the sheet 70, an up button 114 to rewrap the sheet, and a stop button 116 to stop the movement of the sheet. The up and down buttons can be used to override the automatic stop function if a desired image is more than one image away from the existing image being displayed. The controller is connected to the motor 90 which it controls and to photoelectric sensors 118 which are used to determine the position of the sheet and the images thereon relative to the front 21 of the container body 22. Controllers such as the one used with the present invention are well known in the field of scroll signs. One type of photoelectrical sensor used with success is the Tri-Tronics UD-AT1.

Regardless of the embodiment used, the present invention provides a public display apparatus which provides a large, high quality visual image for public events. Multiple photographic quality images can be display in a large format without distortion. Since the mechanical elements of the invention are relatively simple reliability and maintanence are at very acceptable levels. Also, the display can be easily transported if that is desired by the operators. At the same time, the present invention is equally useful and successful in fixed locations such as being built into stages.

I claim:

1. A public display apparatus for displaying large, high quality images, said public display apparatus comprising:

a container body, said container body having a front, a back, a top, a bottom, and at least two sides, said container body further being substantially hollow and said front being substantially open;

a driven roller, said driven roller being an elongated cylinder with two ends, said driven roller being substantially as long as said container body, and further said driven roller being rotatably attached to and inside of said container body proximate said container body back and top;

a tension roller, said tension roller being an elongated cylinder with two ends, said tension roller being substantially as long as said container body, and further said tension roller being rotatably attached to and inside of said container body proximate said container body back and bottom with said tension roller being substantially parallel to said driven roller;

a tension source, said tension source being connected to said tension roller, said tension source supplying a torsional force to said tension roller, said torsional force allowing said tension roller to rotate freely only in one direction without an external force acting on said tension roller;

an upper support roller, said upper support roller being an elongated cylinder with two ends, said upper support roller being substantially as long as said container body, and further said upper support roller being rotatably attached to and inside of said container body front and top with said upper support roller being substantially parallel to said driven and tension rollers;

a lower support roller, said lower support roller being an elongated cylinder with two ends, said lower support roller being substantially as long as said container body, and further said lower support roller being rotatably attached to and inside of said container body proximate said container body front and bottom with said lower support roller being substantially parallel to said driven and tension rollers;

a driving source, said driving source being connected to said driven roller, said driven roller being rotated by said driving source when said driving source is energized;

at least two support arms, each said support arm having a fixed end and a roller end, each said roller end having at least two support wheels rotatably attached to it, each said support arm being inside said container body with each said fixed end being attached to said container body back, with one support arm extending toward one end of the upper support roller and in contact and supporting therewith, and with the other support arm extending toward one end of the lower support roller and in contact and supporting therewith;

said tension source further comprising a tension spring, said tension spring being attached to and inside of said tension roller to provide said torsional force;

said driving source comprising a motor connected to said driven roller;

a controller, said controller controlling said motor and rotation of said driven roller;

a sheet, said sheet being made of transparent flexible material and having a rectangular shape with visual images being transferred to said sheet;

said sheet being wrapped around said driven roller, passing around and over said upper support roller, passing around and over said lower support roller, and being wrapped around said tension roller;

a light source, said light source being located within said container body and behind said sheet;

a crash shield, said crash shield being transparent and substantially covering said container body front;

a shelf, said shelf being substantially flat with a front edge and a back edge and a length substantially equal to said container body length, said shelf being attached to said container body back proximate said container body top with at least one hinge so that said shelf can swing down against said container body back; and at least one shelf support assembly, each said shelf support assembly being attached to said container body back with said hinge being vertically oriented allowing said shelf support assembly to swing laterally relative to said container body, each shelf support assembly further having a shelf support rail which holds said shelf in a horizontal position, and having a lower member with an adjustable foot.

* * * * *